United States Patent [19]

Yamazaki et al.

[11] 4,117,673

[45] Oct. 3, 1978

[54] EXHAUST REACTION ASSEMBLY FOR INTERNAL COMBUSTION ENGINE

[75] Inventors: Shuichi Yamazaki, Kamifukuoka; Ikuo Kajitani, Niiza, both of Japan

[73] Assignee: Honda Giken Kogyo Kabushiki Kaisha, Tokyo, Japan

[21] Appl. No.: 718,676

[22] Filed: Aug. 30, 1976

[30] Foreign Application Priority Data

Sep. 4, 1975 [JP] Japan ..... 50-106493

[51] Int. Cl.[2] ..... F01N 3/10

[52] U.S. Cl. ..... 60/282; 60/323

[58] Field of Search ..... 60/282, 323, 322, 274

[56] References Cited

U.S. PATENT DOCUMENTS

| | | | |
|---|---|---|---|
| 3,413,803 | 12/1968 | Rosenlund | 60/282 |
| 3,914,936 | 10/1975 | Okitsu | 60/282 |
| 3,965,881 | 6/1976 | Sakurai | 60/282 |
| 3,990,234 | 11/1976 | Kajitani | 60/282 |
| 4,016,846 | 4/1977 | Nakano | 123/122 AB |

*Primary Examiner*—Douglas Hart
*Attorney, Agent, or Firm*—Lyon & Lyon

[57] ABSTRACT

An exhaust reaction chamber assembly is provided for a four-cylinder in-line internal combustion engine having two pairs of exhaust ports, the ports in each pair being closely spaced. The assembly includes an exhaust manifold having two preliminary reaction chambers each connected to receive exhaust gases from one of said pairs of exhaust ports, respectively. A main reaction chamber is provided within the exhaust manifold and two curved passages each connect one of the preliminary reaction chambers to the main reaction chamber, respectively, each passage curving for about 90°. The passages have aligned outlets so that the exhaust gases from each passage are directed toward the other passage. The gases are then directed perpendicular to the inlet in an elongated direction through the main reaction chamber. In one embodiment, the aligned outlets are spaced apart within the main reaction chamber, and in a modification the aligned outlets are formed in a single pipe having a side window opening into the main reaction chamber. A restriction may be placed between each passage and the preliminary reaction chamber to which it is connected, in order to increase residence time.

8 Claims, 4 Drawing Figures

1
6a
6b
6c
8
5
8
9
6
7
7a
7a
7
4
4
3
3
3
3
2
2
1

EXHAUST REACTION ASSEMBLY FOR INTERNAL COMBUSTION ENGINE

This invention relates to an exhaust reaction chamber assembly for a multi-cylinder internal combustion engine and has for its general object the reduction of emissions of objectionable exhaust gas components into the atmosphere.

Recently, in engines of this type, in order to control the generation of NOx, a relatively lean air-fuel mixture is employed, so lean as to be close to the combustible limit. Such a lean mixture results in a relatively low combustion temperature, and as a result the temperature of the exhaust gases are relatively low. It is an important feature of this invention to minimize further loss in temperature as the exhaust gases pass through reaction chambers in the exhaust manifold. Oxidation of pollutants other than NOx is thus enhanced, and the oxidation reactions tend to raise the temperature of the exhaust gases.

It is therefore an object of this invention to provide an exhaust reaction chamber assembly which maintains the temperature of the exhaust gases as high as possible for a long residence time, even though the engine is operated on a very lean air-fuel mixture. This is accomplished by providing a pair of preliminary reaction chambers each of which receives exhaust gases from at least a pair of exhaust ports of the internal combustion engine and each of which preliminary reaction chambers discharges to a main reaction chamber within the exhaust manifold of the engine. The discharge ends of the passages which connect the preliminary reaction chambers to the main reaction chamber are aligned so that exhaust gases discharged from one passage are directed into the other passage, respectively.

Another feature of the invention relates to the provision of a restriction between each preliminary reaction chamber and its respective passage which is connected to the main reaction chamber, in order to increase residence time.

Another feature of this invention relates to the construction in which a single pipe connects the passages leading from the preliminary reaction chambers, and the pipe is provided with a window at one side for discharging exhaust gases into the main reaction chamber.

Other and more detailed objects and advantages will appear hereinafter.

Figure 1:
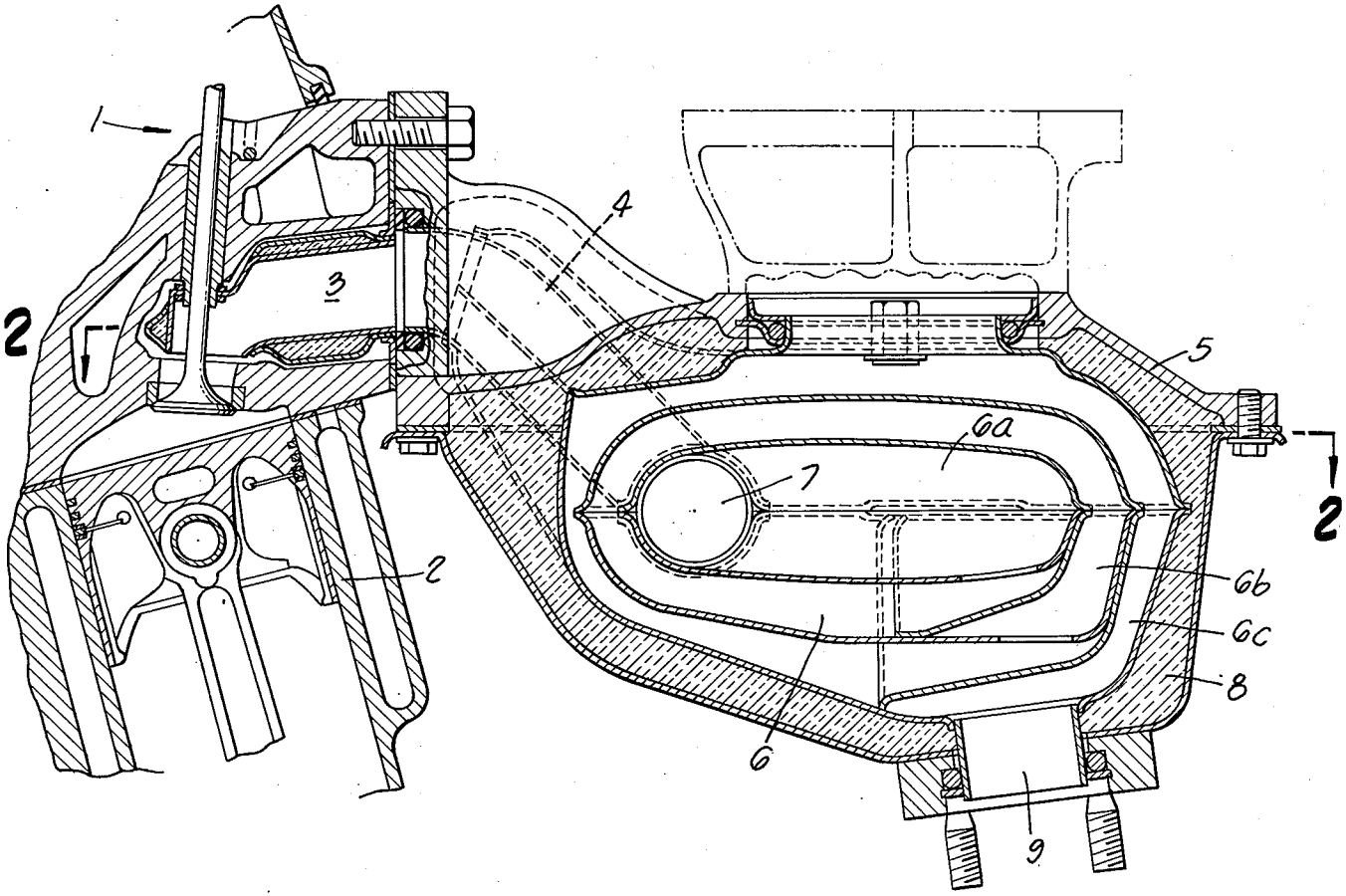
FIG. 1 is a sectional side elevation showing a preferred embodiment of this invention.

Referring to the drawings, an internal combustion engine 1 has four cylinders 2 arranged in an in-line configuration. Exhaust ports 3 are positioned in closely spaced pairs and each pair discharges into a preliminary reaction chamber 4 positioned within the exhaust manifold 5. The two preliminary reaction chambers 4 are laterally spaced.

Figure 2:
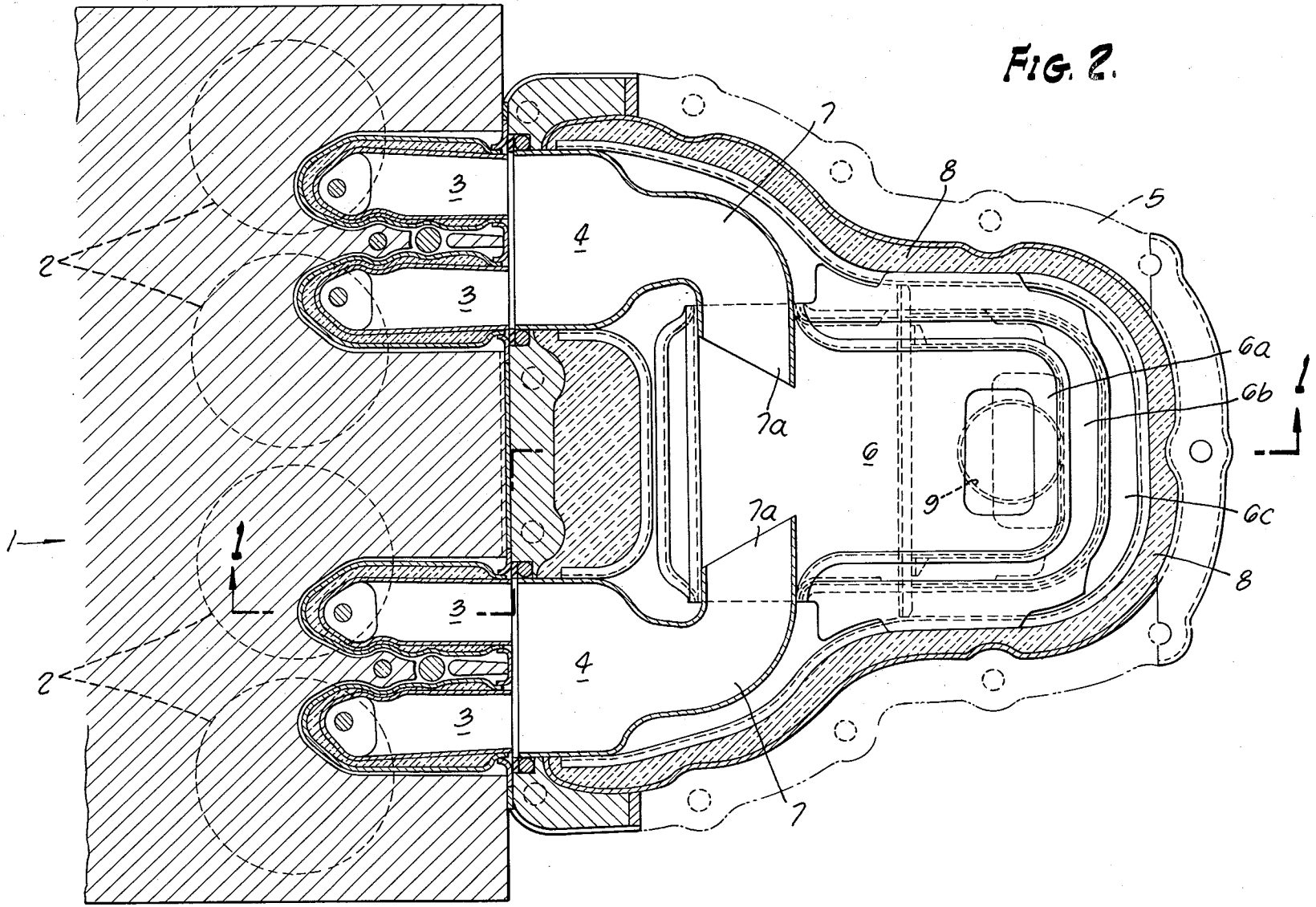
FIG. 2 is a sectional plan view taken substantially on the lines 2—2 as shown in FIG. 1.

A main reaction chamber 6 is positioned within the exhaust manifold 5 and receives exhaust gases from two elbow passages 7 each connected to one of the preliminary reaction chambers 4. These curved passages 7 turn through about 90° and each is provided with an end opening *7a* within the main reaction chamber 6. The end openings *7a* are spaced apart and are aligned so that each passage 7 discharges into the end opening *7a* of the other passage 7. As can be seen in FIG. 2, the discharge of passages 7 at end openings *7a* is at one end of the main reaction chamber 6. The main reaction chamber 6 is elongated in a direction perpendicular to a line between the passages 7 end openings *7a*. Insulation material 8 is provided around the preliminary reaction chambers 4 and the main reaction chamber 6, all within the exhaust manifold 5.

The main reaction chamber 6 is divided into three subchambers *6a*, *6b* and *6c* connected in series to each other so as to introduce exhaust gases from the innermost chamber *6a* through the intermediate chamber *6b* to the outermost chamber *6c*. The exhaust gases are finally discharged from the outermost chamber *6c* through the pipe 9.

In the operation of the preferred form of the invention shown in FIGS. 1 and 2 of the drawings, the exhaust gases discharged from the pairs of exhaust ports 3 are mixed in the preliminary reaction chambers 4 to cause a rise in temperature by oxidation reactions. The exhaust gases then pass through the elbow passages 7 into the main reaction chamber 6. The end portions *7a* of the passages 7 oppose each other so that the exhaust gases are thoroughly mixed to produce a further temperature rise. Thus, the exhaust gases become relatively high in temperature as they pass through the main reaction chamber 6.

The confluence of exhaust gases in each preliminary reaction chamber 4 causes them to mix because the exhaust pulsations are not simultaneous, but differ somewhat in time from each other. The two streams of exhaust gases moving through the elbow passages 7 then meet in the subchamber *6a* of the main reaction chamber 6, and thorough mixing of the two streams of exhaust gases is accomplished because the discharge ends *7a* of the passages 7 are aligned. The temperature of the exhaust gases is prevented from falling to any great extent, and the relatively long residence time which is achieved before the exhaust gases escape through the pipe 9 enables the desired oxidation reactions to occur for minimizing discharge of pollutants into the atmosphere.

Figure 3:
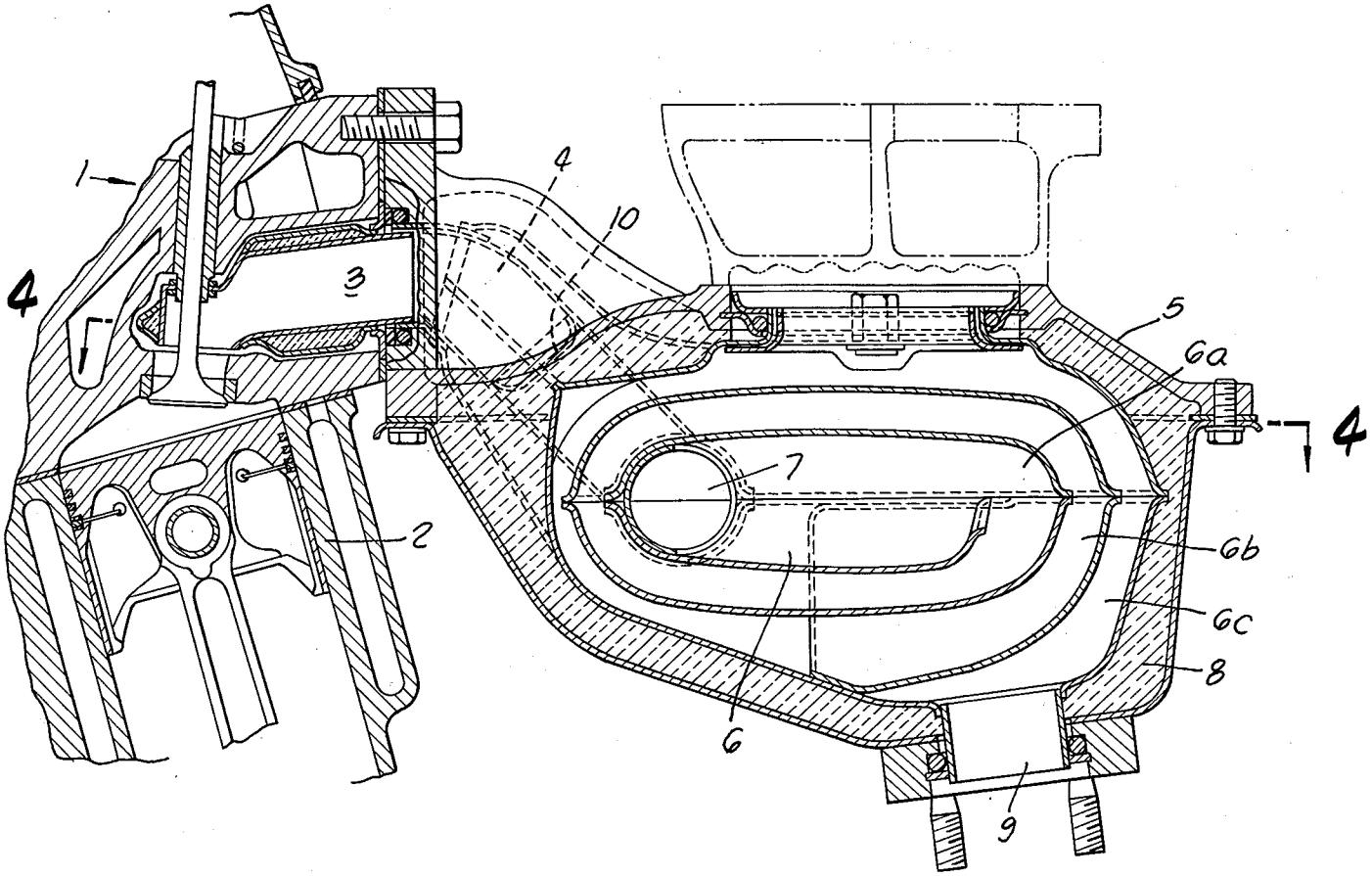
FIG. 3 is a view similar to FIG. 1 showing a modification.
Figure 4:
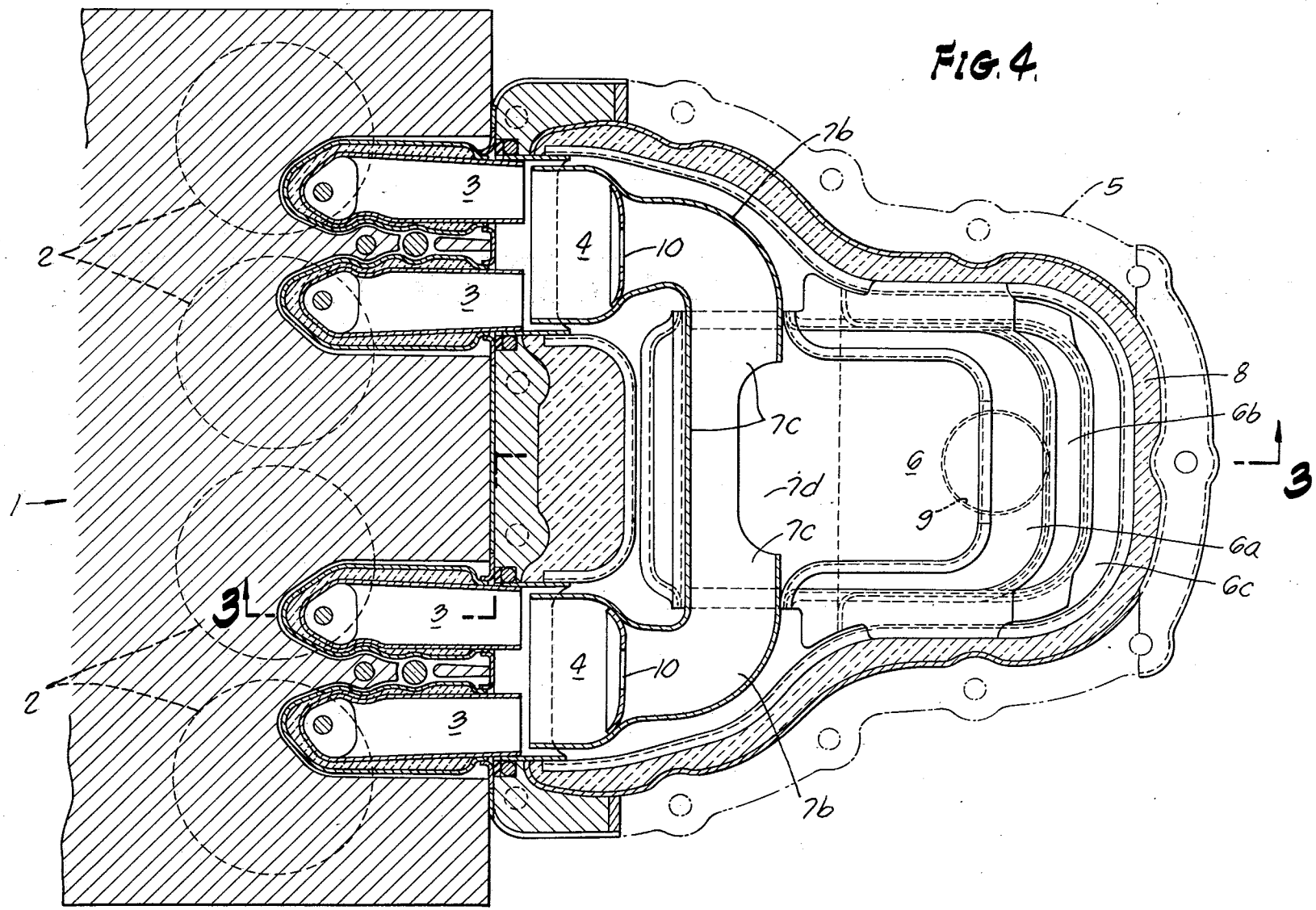
FIG. 4 is a sectional plan view taken substantially on the lines 4—4 as shown in FIG. 3.

A modified form of the invention shown in FIGS. 3 and 4 is similar to that previously described with the exception that apertured restriction plates 10 are placed between each preliminary reaction chamber *4a* and its respective elbow passage *7b*. Also, a single pipe *7c* connects the two elbow passages *7b* and a window *7d* is formed in one side of the pipe through which exhaust gases pass into the main reaction chamber 6. The restriction plates 10 serve to increase the residence time of the exhaust gases in the preliminary reaction chambers 4, and the single pipe *7c* construction with the lateral window *7d* increases to some extent the residence time of the exhaust gases within the elbow passages leading to the main reaction chamber 6.

Having fully described our invention, it is to be understood that we are not to be limited to the details herein set forth but that our invention is of the full scope of the appended claims.

We claim:

1. An exhaust reaction chamber assembly for a multi-cylinder internal combustion engine having at least four exhaust ports spaced to form two groups, comprising, in combination: an exhaust manifold having walls forming two preliminary reaction chambers each adapted to receive exhaust gases from one of said groups of exhaust ports, respectively, the exhaust manifold also having walls forming a main reaction chamber, said main reaction chamber being elongated in a first direction, walls forming a first passage connecting one of said preliminary reaction chambers to said main reaction chamber, walls forming a second passage connecting the other of said preliminary reaction chambers to said main reaction chamber, said passages having aligned outlets so that exhaust gases from each passage are directed toward the other passage and the discharge ends of said passages being at a first end of said main reaction chamber perpendicular to said first direction to cause a mixing of gases entering said main reaction chamber and to cause movement of gases in said first direction substantially perpendicular to the flow of gases into said main reaction chamber.

2. The combination set forth in claim 1 in which the aligned outlets from said passages are spaced apart within said main reaction chamber.

3. The combination set forth in claim 1 in which the aligned outlets from said passages are formed in a single pipe having a side window opening into said main reaction chamber.

4. The combination set forth in claim 1 in which a restriction is placed between each passage and the preliminary reaction chamber to which it is connected.

5. An exhaust reaction chamber assembly for a four-cylinder in-line internal combustion engine having two pairs of exhaust ports, the ports in each pair being closely spaced, comprising, in combination: an exhaust manifold having walls forming two preliminary reaction chambers each adapted to receive exhaust gases from one of said pairs of exhaust ports, respectively, the exhaust manifold also having walls forms a main reaction chamber, said main reaction chamber being elongated in a first direction, walls forming two curved passages each connecting one of said preliminary reaction chambers to said main reaction chamber, respectively, each passage curving for about 90°, said passages having aligned outlets so that exhaust gases from each passage are directed toward the other passage and said passages discharging at a first end of said main reaction chamber perpendicular to said first direction to cause a mixing of gases entering said main reaction chamber and to cause movement of gases in said first direction substantially perpendicular to the flow of gases into said main reaction chamber.

6. The combination set forth in claim 5 in which the aligned outlets from said passages are spaced apart within said main reaction chamber.

7. The combination set forth in claim 5 in which the aligned outlets from said passages are formed in a single pipe having a side window opening into said main reaction chamber.

8. The combination set forth in claim 5 in which a restriction is placed between each passage and the preliminary reaction chamber to which it is connected.

* * * * *